US009190002B2

(12) United States Patent
Kawaguchi

(10) Patent No.: US 9,190,002 B2
(45) Date of Patent: Nov. 17, 2015

(54) DISPLAY DEVICE

(71) Applicant: Panasonic Liquid Crystal Display Co., Ltd., Hyogo (JP)

(72) Inventor: Seiji Kawaguchi, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 192 days.

(21) Appl. No.: 14/030,341

(22) Filed: Sep. 18, 2013

(65) Prior Publication Data

US 2014/0085175 A1 Mar. 27, 2014

(30) Foreign Application Priority Data

Sep. 21, 2012 (JP) ..... 2012-208035

(51) Int. Cl.
*G09G 3/36* (2006.01)

(52) U.S. Cl.
CPC ..... *G09G 3/3611* (2013.01); *G09G 3/3614* (2013.01); *G09G 3/3677* (2013.01); *G09G 2320/041* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,049,318 | A * | 4/2000 | Ota | 345/93 |
| 2009/0219242 | A1* | 9/2009 | Fuchigami et al. | 345/100 |
| 2010/0309175 | A1* | 12/2010 | Ohtsuki | 345/204 |
| 2012/0154343 | A1* | 6/2012 | Yu et al. | 345/204 |

FOREIGN PATENT DOCUMENTS

JP 2005-140883 6/2005

* cited by examiner

*Primary Examiner* — Kumar Patel
*Assistant Examiner* — Amy C Onyekaba
(74) *Attorney, Agent, or Firm* — Wenderoth, Lind & Ponack, L.L.P.

(57) ABSTRACT

A display device includes a display portion, a source driver that is connected to a second end of a source signal line to output to the source signal line a first source signal for a first pixel electrode and a second source signal for a second pixel electrode, a gate driver that outputs first and second gate signals to first and second gate signal lines, and a controller that controls the gate driver and the source driver to control output timings of the first and second gate signals relative to output timings of the first and second source signals. The controller sets a first time interval from the output timing of the first source signal to the output timing of the first gate signal to be longer than a second time interval from the output timing of the second source signal to the output timing of the second gate signal.

8 Claims, 8 Drawing Sheets

DISPLAY DEVICE

CROSS-REFERENCE TO RELATED APPLICATIONS

This application claims the benefit of priority to Japanese Patent application No. 2012-208035 filed on Sep. 21, 2012, the entire content of which is hereby incorporated herein by reference.

TECHNICAL FIELD

The present disclosure relates to a display device that displays an image on a display portion.

BACKGROUND

A liquid crystal display device is used as a display device such as a high definition color monitor of a computer or other information equipments, a television receiver, or the like. Basically, the liquid crystal display device includes a liquid crystal display portion that has liquid crystal disposed between two substrates, at least one of which is formed by transparent glass or the like. The liquid crystal display device is provided with a driver that selectively applies voltage to pixel electrodes formed on the substrate of the liquid crystal display portion. When the voltage is applied by the driver, pixels of the respective pixel electrodes are controlled.

In general, the liquid crystal display portion is provided with gate signal lines, source signal lines, and pixel electrodes. The gate signal lines respectively extend in a horizontal direction (main scanning direction), and are arranged next to each other in a vertical direction (sub scanning direction), for example. The source signal lines respectively extend in the vertical direction (sub scanning direction), and are arranged next to each other in the horizontal direction (main scanning direction), for example. Thin film transistors (TFTs) and the pixel electrodes are arranged in matrix at intersection points of the gate signal lines and the source signal lines. A gate driver applies voltage (gate signal) to the gate signal lines for turning on and off the TFTs. A source driver applies voltage (source signal) to the source signal lines based on an input image signal to the pixel electrodes, to control transmittance of the liquid crystal that is provided correspondingly to the pixel electrodes, to the value corresponding to the source signal.

In the conventional liquid crystal display device, a difference in waveforms of the source signal may occur depending on positions of the pixel electrodes, even though the source signal having the same level is applied to the pixel electrodes by the source driver. For example, in the pixel electrode that is at a position separated from the source driver, the waveform of the source signal is rounded and becomes a gradually changing waveform, as compared with the waveform in the pixel electrode that is at the position closer to the source driver. Therefore, when the output of the gate signal is finished before the level of the source signal that is applied to the pixel electrode changes to a desired value, the transmittance of the liquid crystal that is provided correspondingly to the pixel electrode may not be controlled to have the desired value. As a result of this, quality of the image to be displayed on the display portion may be deteriorated.

In view of the above, a display device described in Japanese Patent Application Laid-Open No. 2005-140883, for example, employs a precharge mode, in which a signal (precharge voltage) that is higher than a source signal based on the input image signal is applied in the first half of one horizontal scanning period, and the source signal based on the input image signal is applied in the latter half of one horizontal scanning period, so that the level of the source signal to be applied to the pixel electrode changes to the desired value before the output of the gate signal is finished.

According to the display device described in the Japanese Patent Application Laid-Open No. 2005-140883, however, control structure is complicated in order to apply the precharge voltage having the appropriate level according to the position of the pixel electrode.

SUMMARY

An object of the present disclosure is to provide a display device capable of reducing influences due to a difference between waveforms of source signals with a simple control structure, the difference being caused by positions of pixel electrodes.

In one general aspect, the instant application describes a display device which may include a display portion that has a source signal line extending from a first end to a second end, a first gate signal line crossing the source signal line, a second gate signal line crossing the source signal line at a position closer to the second end than the first gate signal line, a first pixel electrode connected to the source signal line and the first gate signal line, and a second pixel electrode connected to the source signal line and the second gate signal line; a source driver that is connected to the second end of the source signal line to output to the source signal line a first source signal for the first pixel electrode and a second source signal for the second pixel electrode; a gate driver that outputs a first gate signal to the first gate signal line and a second gate signal to the second gate signal line; and a controller that controls the gate driver and the source driver to control output timings of the first gate signal and the second gate signal relative to output timings of the first source signal and the second source signal, wherein the controller sets a first time interval from the output timing of the first source signal to the output timing of the first gate signal to be longer than a second time interval from the output timing of the second source signal to the output timing of the second gate signal.

According to the present disclosure, it is possible to reduce the influences due to the difference between the waveforms of the source signals in the first pixel electrode and in the second pixel electrode, having different distances from the source driver, with a simple control structure that only increases the first time interval to be longer than the second time interval. As a result of this, it is possible to reduce a degree of deterioration in the quality of the image to be displayed on the display portion.

DETAILED DESCRIPTION

Figure 1:
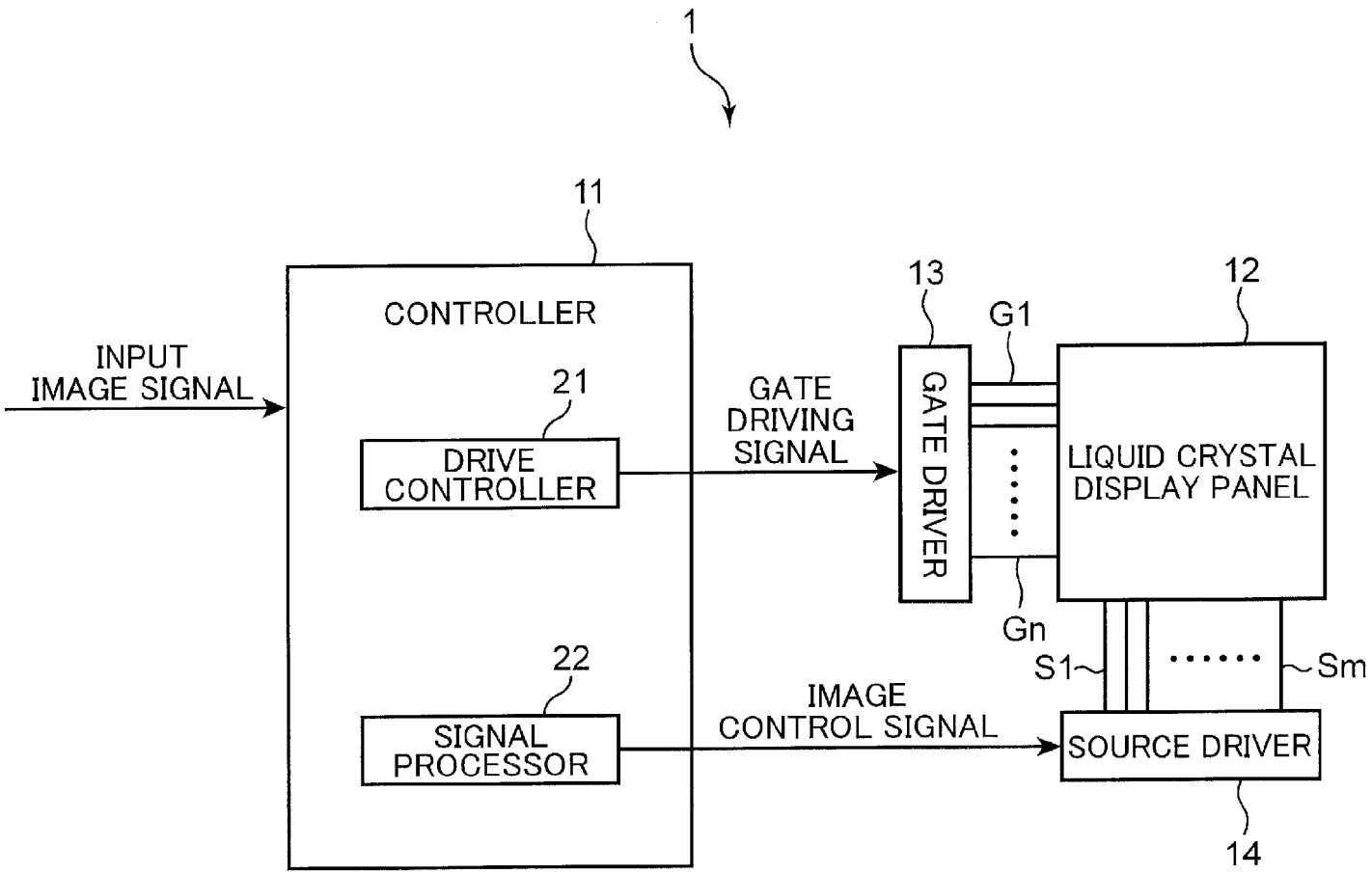
FIG. 1 is a block diagram showing a structure of a liquid crystal display device according to an embodiment of the present application.
Figure 2:
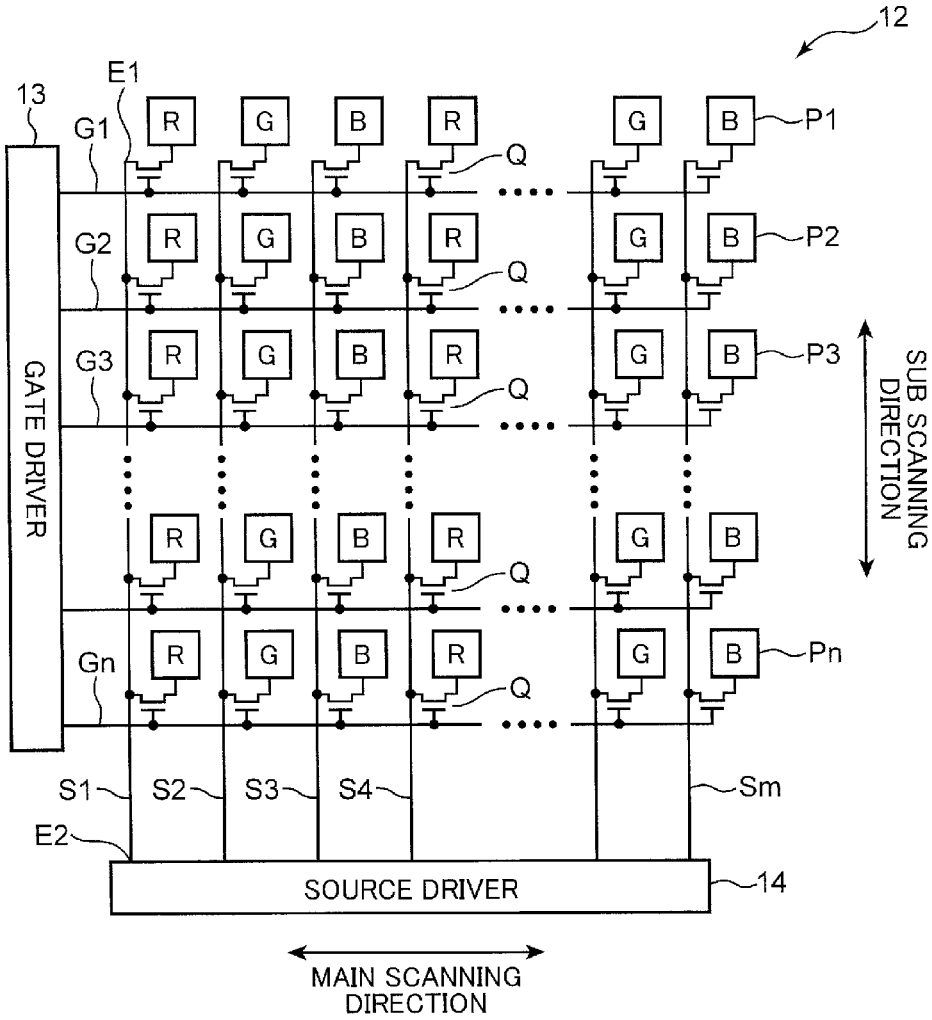
FIG. 2 is a circuit diagram showing the connection between signal lines of a liquid crystal display panel shown in FIG. 1.

FIG. 1 is a block diagram showing a structure of a liquid crystal display device according to an embodiment of the present application. FIG. 2 is a circuit diagram showing the connection between signal lines of a liquid crystal display panel shown in FIG. 1. As shown in FIG. 1, a liquid crystal display device 1 is provided with a controller 11, a liquid crystal display panel 12, a gate driver 13, and a source driver 14.

As shown in FIG. 2, the liquid crystal display panel 12 is provided with source signal lines S1, S2, . . . , Sm, gate signal lines G1, G2, . . . , Gn, thin film transistors Q, and pixel electrodes R, G and B (namely, red pixel electrodes R, green pixel electrodes G, and blue pixel electrodes B). The source signal lines S1, S2, . . . , Sm respectively extend in a vertical direction (sub scanning direction), and are arranged next to each other in a horizontal direction (main scanning direction). The gate signal lines G1, G2, . . . , Gn respectively extend in the horizontal direction (main scanning direction), and are arranged next to each other in the vertical direction (sub scanning direction). The thin film transistors Q and the pixel electrodes R, G and B are arranged in matrix at intersection points of the source signal lines S1, S2, . . . , Sm and the gate signal lines G1, G2, . . . , Gn.

As shown in FIG. 2, the source signal line S1 extends from an upper end E1 to a lower end E2. The source signal lines S2 to Sm also extend from upper ends to lower ends, respectively. The source driver 14 is connected to the lower ends of the source signal lines S1 to Sm (the lower end E2 of the source signal line S1).

The controller 11 controls the gate driver 13 and the source driver 14, to apply voltage corresponding to an input image signal to the pixel electrodes R, G and B that are arranged in matrix in the liquid crystal display panel 12 once for each frame. In other words, the controller 11 writes image data once for one frame, into pixels (liquid crystal) of the pixel electrodes R, G and B that are arranged in matrix in the liquid crystal display panel 12.

The controller 11 is provided with a drive controller 21 and a signal processor 22. The drive controller 21 outputs a gate driving signal to the gate driver 13. Based on the gate driving signal, the gate driver 13 applies scanning voltage (gate signal) to the gate signal lines G1, G2, . . . , Gn in order from the top to the bottom, and turns on the corresponding thin film transistors Q of the gate signal lines G1, G2, . . . , Gn in order.

Based on the input image signal, the signal processor 22 outputs an image control signal to the source driver 14 to control the source driver 14. The source driver 14 applies voltage (source signal) corresponding to the input image signal to the pixel electrodes R, G and B corresponding to the gate signal lines G1, G2, . . . , Gn that are selected by the gate driver 13 (that is, the thin film transistors Q are turned on), via the source signal lines S1, S2, . . . , Sm. This causes the voltage corresponding to the input image signal to be applied to the pixels (liquid crystal) of the pixel electrodes R, G and B, and transmittance of the pixels (liquid crystal) of the pixel electrodes R, G and B to be controlled.

When the application of the source signal to the gate signal lines G1, G2, . . . , Gn is completed from the top to the bottom by the gate driver 13 and the source driver 14, the image data corresponding to the input image signal is written into all the pixels for one time. When the image data is written into all the pixels, an image of one frame is generated. The liquid crystal display panel 12 is a hold-type display portion that holds the written image data for a period of one frame, until the next image data is written therein.

When the image generation of one frame is repeated by the controller 11 at a predetermined frame frequency, the images displayed on the liquid crystal display panel 12 are viewed by viewers. Note that, an in plane switching (IPS) type, a vertical alignment (VA) type, and any other type of liquid crystal display panels may be employed as the liquid crystal display panel 12.

Figure 3:
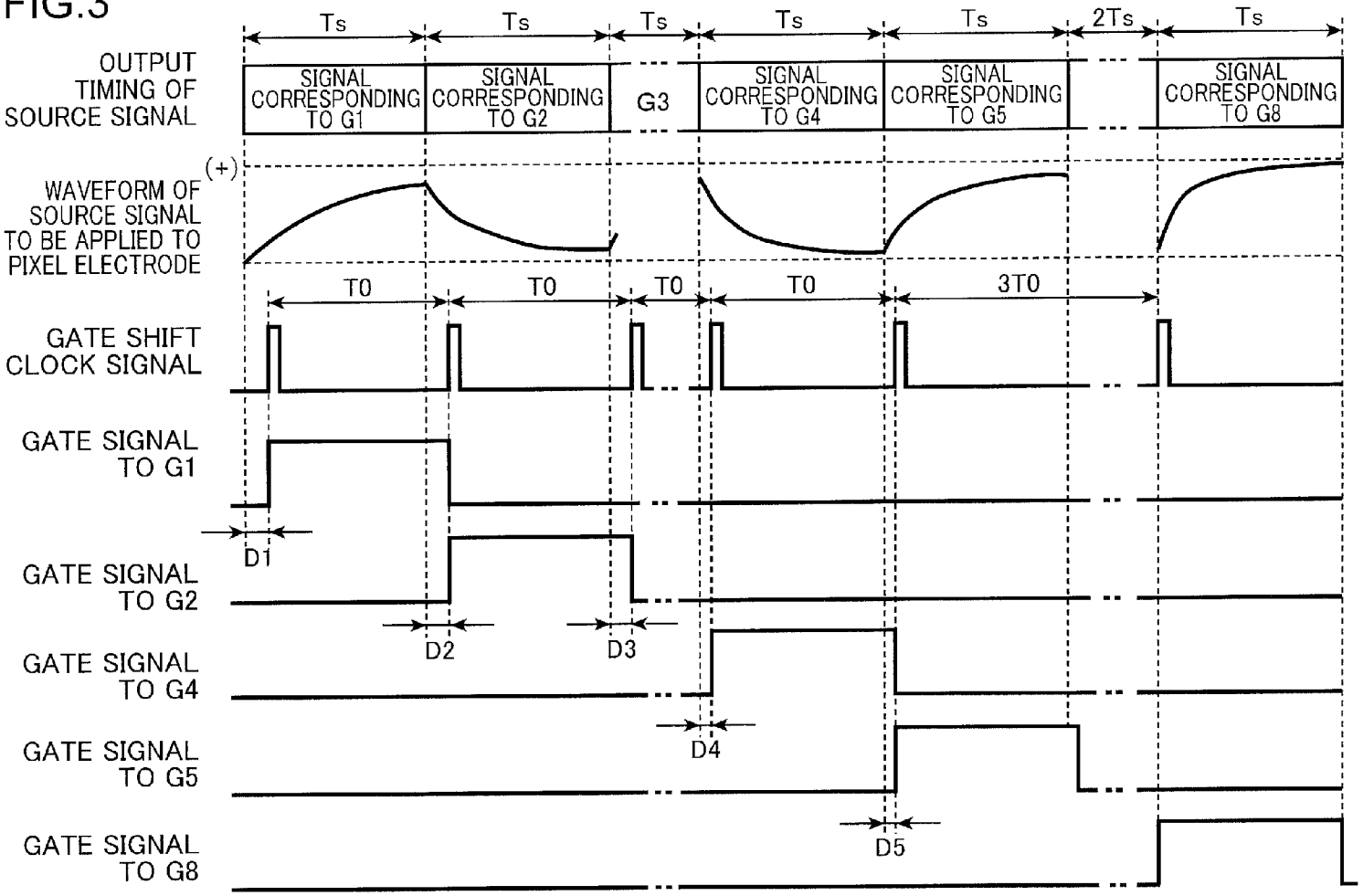
FIG. 3 is a timing chart showing signals at respective parts for one frame.

FIG. 3 is a timing chart showing signals at respective parts for one frame. In FIG. 3, the number of the gate signal lines is defined as n=8, and illustrations of signals corresponding to the gate signal lines G3, G6 and G7 are omitted. Output timings of the gate signal and the source signal by the controller 11, according to this embodiment, will be described with reference to FIG. 1 to FIG. 3.

As shown in "output timing of source signal" in FIG. 3, the source signal to the source signal lines S1 to Sm is output to each of the gate signal lines G1 to G8 in order for a fixed period Ts. Specifically, the source signal to the source signal lines S1 to Sm, corresponding to the gate signal line G1, is output for the fixed period Ts. Next, the source signal to the source signal lines S1 to Sm, corresponding to the gate signal line G2, is output for the fixed period Ts. Then, the source signal is repeatedly output to the source signal lines S1 to Sm until the source signal corresponding to the gate signal line G8 is output.

"Waveform of source signal to be applied to pixel electrode" in FIG. 3 shows, for example, a waveform of the voltage output to the source signal line S1 in FIG. 2. An example of a column inversion drive mode is illustrated in FIG. 3, and a voltage having the same polarity is applied to the gate signal lines G1 to G8. According to the column inversion drive mode, when the polarity of the voltage output to the source signal line S1 is (+), as shown in FIG. 3, the polarity of the voltage output to the source signal lines S2, S4, . . . is set as (−), and the polarity of the voltage output to the source signal lines S3, S5, . . . is set as (+). In FIG. 3, the signal level of the input image signal corresponding to the gate signal lines G1, G5 and G8 is high, and the signal level of the input image signal corresponding to the gate signal lines G2 and G4 is low.

As shown in FIG. 3, a waveform of the source signal to be applied to the pixel electrodes corresponding to the gate signal line G8 changes steeply. Meanwhile, waveforms of the source signals to be applied to the pixel electrodes corresponding to the gate signal lines G1 and G2 change gently. The degree of change of waveforms of the source signals to be applied to the pixel electrodes corresponding to the gate signal lines G4 and G5 is between the two waveforms. Such a difference in the signal waveforms is caused by a difference in distances between the source driver 14 and the respective pixel electrodes.

As shown in FIG. 2, a distance between a pixel electrode P1 corresponding to the gate signal line G1 and the source driver 14 is the longest. Distances between pixel electrodes P2, P3, . . . corresponding to the gate signal lines G2, G3, . . . and the source driver 14 are reduced gradually. A distance between a pixel electrode Pn corresponding to the gate signal line Gn and the source driver 14 is the shortest.

For this reason, the waveform of the source signal to be applied to the pixel electrodes corresponding to the gate signal line G8 changes steeply, as shown in FIG. 3, due to the smallest influence of a capacity component by the liquid crystal and a resistance component by a wire length. Meanwhile, the waveform of the source signal to be applied to the pixel electrodes corresponding to the gate signal line G1 is rounded and changes gently, due to the largest influence of the capacity component by the liquid crystal and the resistance component by the wire length.

As shown in "gate shift clock signal" in FIG. 3, the gate shift clock signal is output at fixed intervals T0. In synchronization with the gate shift clock signal, the gate signal to the gate signal line G1 changes to a high level during the width of one horizontal period T0 until the next gate shift clock signal is output. As shown in FIG. 3, the gate signal is shifted toward the gate signal line G8, in synchronization with the gate shift clock signal.

In FIG. 3, a time interval between the output timing of the gate signal to the gate signal line G1 and the output timing of the source signal corresponding to the gate signal line G1 is defined as a time interval D1. Similarly, time intervals between the output timing of the gate signal to the gate signal lines G2, G3, G4 and G5 and the output timing of the source signal corresponding to the gate signal lines G2, G3, G4 and G5 are defined as time intervals D2, D3, D4 and D5, respectively. Although illustrations are omitted, time intervals between the output timing of the gate signal to the gate signal lines G6 and G7 and the output timing of the source signal corresponding to the gate signal lines G6 and G7 are defined as time intervals D6 and D7, respectively. Meanwhile, a time interval between the output timing of the gate signal to the gate signal line G8 and the output timing of the source signal corresponding to the gate signal line G8 is zero. In other words, the output timings of the both are in agreement with each other.

Thus, in the gate signal lines G1 to G7, the gate shift clock signal is output so as to cause the output timing of the gate signal to be later than the output timing of the source signal. Here, the time intervals D1 to D7 between the output timing of the gate signal to the gate signal lines G1 to G7 and the output timing of the source signal corresponding to the gate signal lines G1 to G7 are respectively set according to the distances between the pixel electrodes corresponding to the gate signal lines G1 to G7 and the source driver 14. For example, the time interval D1 is set according to a distance between the pixel electrode P1 (FIG. 2) and the source driver 14, and the time interval D2 is set according to a distance between the pixel electrode P2 (FIG. 2) and the source driver 14. In other words, the gate shift clock signal is output so that the time intervals D1 to D7 have the relationship of D1>D2>D3>D4>D5>D6>D7.

In this embodiment, the liquid crystal display panel 12 corresponds to an example of a display portion, the upper end E1 corresponds to an example of a first end, the lower end E2 corresponds to an example of a second end, the gate signal line G1 corresponds to an example of a first gate signal line, the gate signal line G2 corresponds to an example of a second gate signal line, the gate signal line G3 corresponds to an example of a third gate signal line, the pixel electrode P1 connected to the gate signal line G1 corresponds to an example of a first pixel electrode, the pixel electrode P2 connected to the gate signal line G2 corresponds to an example of a second pixel electrode, the pixel electrode P3 connected to the gate signal line G3 corresponds to an example of a third pixel electrode, the source signal corresponding to the gate signal line G1 corresponds to an example of a first source signal, the source signal corresponding to the gate signal line G2 corresponds to an example of a second source signal, the time interval D1 corresponds to an example of a first time interval, the time interval D2 corresponds to an example of a second time interval, and the time interval D3 corresponds to an example of a third time interval.

As described above, in this embodiment, the time intervals between the output timing of the gate signal to the gate signal lines and the output timing of the source signal corresponding to the gate signal lines are set according to the distances between the pixel electrodes corresponding to the gate signal lines and the source driver 14. It should be noted that, when the distance between the pixel electrode and the source driver 14 is increased, a degree of rounding of the waveform of the source signal to be applied to the pixel electrode is increased. Therefore, in this embodiment, when the degree of rounding of the waveform of the source signal to be applied to the pixel electrode is increased, the time interval is increased. Thus, the gate signal is output after the waveform of the source signal is changed sufficiently. As a result, it is possible to reduce influences due to the rounding of the waveform of the source signal, according to this embodiment.

In other words, the transmittance of the liquid crystal may be deviated from a target value due to the rounding of the waveform of the source signal. According to this embodiment, however, the deviation of the transmittance of the liquid crystal from the target value can be reduced. This makes it possible to reduce a degree of deterioration in quality of the image to be displayed on the display portion.

Figure 4:
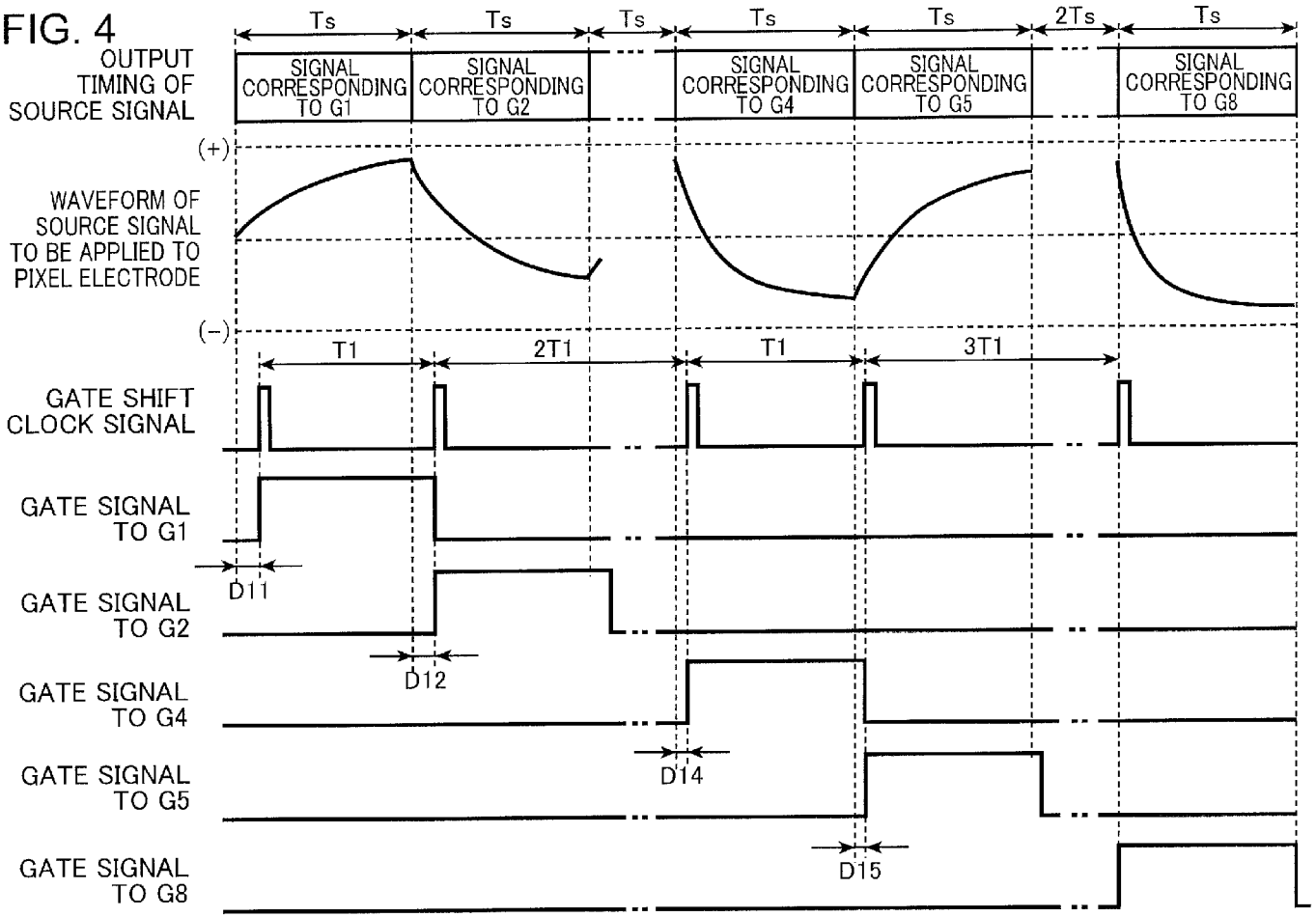
FIG. 4 is a timing chart showing the signals at the respective parts for one frame, according to a drive mode that is different from the one shown in FIG. 3.

FIG. 4 is a timing chart showing the signals at the respective parts for one frame, according to a drive mode that is different from the one shown in FIG. 3. FIG. 3 shows the example of the column inversion drive mode, whereas FIG. 4 shows an example of a dot inversion drive mode. In other words, the polarity of the source signal is inverted in each of the gate signal lines G1 to G8.

In FIG. 4, time intervals between the output timing of the gate signal to the gate signal lines G1, G2, G4 and G5 and the output timing of the source signal corresponding to the gate signal lines G1, G2, G4 and G5 are defined as time intervals D11, D12, D14 and D15, respectively. Although illustrations are omitted, time intervals between the output timing of the gate signal to the gate signal lines G3, G6 and G7 and the output timing of the source signal corresponding to the gate signal lines G3, G6 and G7 are defined as time intervals D13, D16 and D17, respectively.

Meanwhile, a time interval between the output timing of the gate signal to the gate signal line G8 and the output timing of the source signal corresponding to the gate signal line G8 is zero, similarly to the case shown in FIG. 3. In other words, the output timings of the both are in agreement with each other. Thus, in FIG. 4, the gate shift clock signal is also output so as to cause the output timing of the gate signal to be later than the output timing of the source signal, in the gate signal lines G1 to G7, similarly to the case shown in FIG. 3.

Here, the time intervals between the output timing of the gate signal to the gate signal lines and the output timing of the source signal corresponding to the gate signal lines are set according to the distances between the pixel electrodes corresponding to the gate signal lines and the source driver 14, similarly to the case shown in FIG. 3. Namely, the gate shift clock signal is output so that the time intervals D11 to D17 have the relationship of D11>D12>D13>D14>D15>D16>D17. In FIG. 4, it is also possible to reduce the influences due to the rounding of the waveform of the source signal, similarly to the case shown in FIG. 3.

When comparisons are made between the column inversion drive mode (FIG. 3) and the dot inversion drive mode (FIG. 4), there are the relationships of D11>D1, D12>D2, D13>D3, D14>D4, D15>D5, D16>D6, and D17>D7. Namely, the time intervals between the output timing of the gate signal to the gate signal lines and the output timing of the source signal corresponding to the gate signal lines are set so that the time intervals in FIG. 4 have greater values than the time intervals in FIG. 3.

In the dot inversion drive mode, the polarity of the applied voltage (source signal) is inverted in each of the gate signal lines. For this reason, the influences of the rounding of the waveform are greater in the dot inversion drive mode than in the column inversion drive mode, in which the polarity of the applied voltage is not inverted. Therefore, by setting the time intervals as above, a difference in the influences due to the rounding of the waveform can be reduced.

It should be noted that, although the dot inversion drive mode is illustrated in FIG. 4, the dot inversion drive mode is not the only mode to be employed in this embodiment. For example, a two-line inversion drive mode, in which the polarity is inverted every two lines, may be employed. According to the two-line inversion drive mode like this, when the distance between the pixel electrode and the source driver 14 is the same, in the case where the polarity of the applied voltage is inverted relative to the polarity of the applied voltage of the immediately preceding gate signal line, the time intervals may be set to have greater values, as described above, as compared with the case where the polarity is not inverted. In other words, the time intervals between the output timing of the gate signal to the gate signal lines and the output timing of the source signal corresponding to the gate signal lines may be set based on the distances between the pixel electrodes and the source driver 14, and whether the polarity of the applied voltage is inverted or not.

Figure 5:
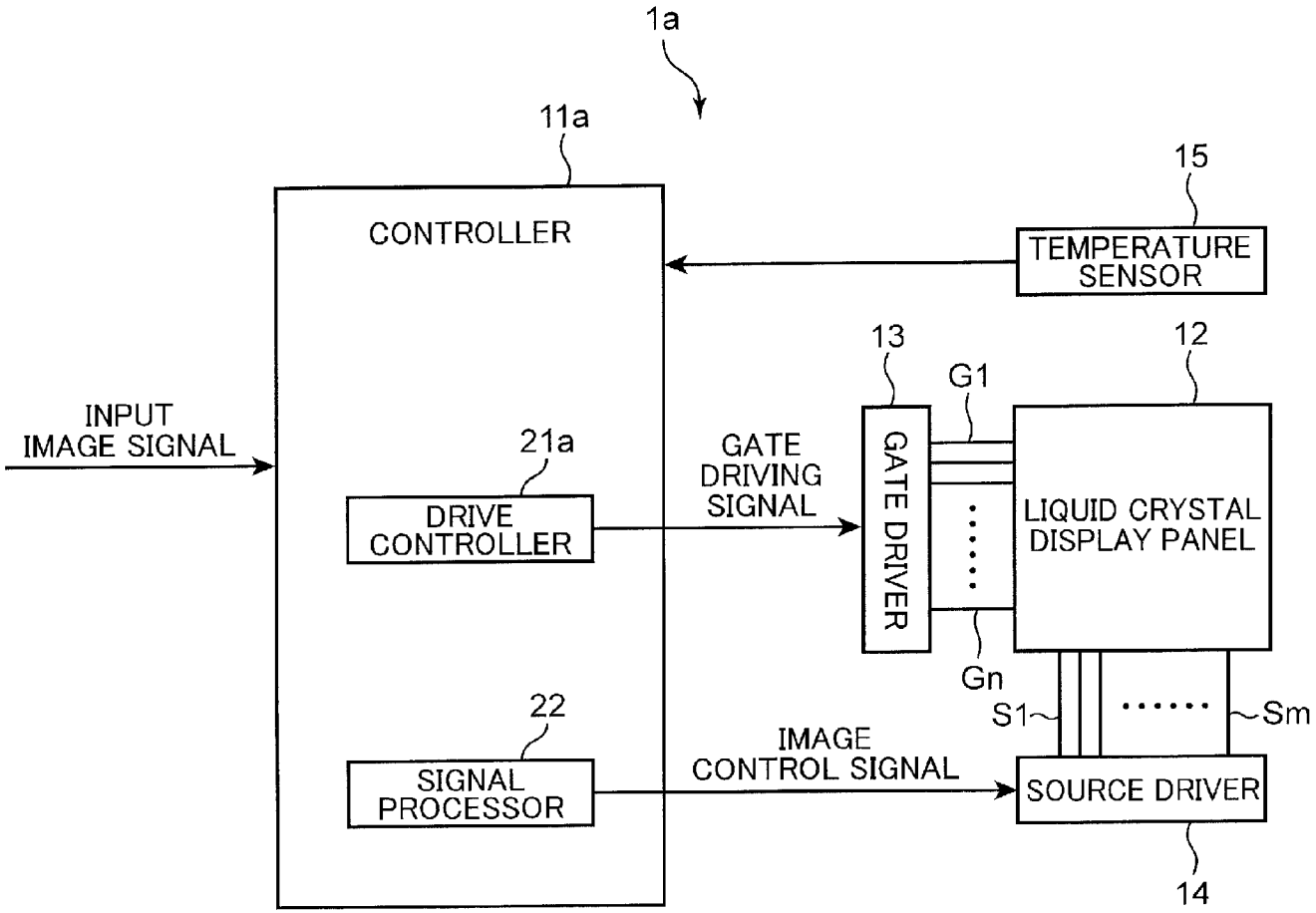
FIG. 5 is a block diagram showing a structure of a liquid crystal display device according to another embodiment.

FIG. 5 is a block diagram showing a structure of a liquid crystal display device according to another embodiment. In FIG. 5, the same numerals and symbols are used to designate the same components as those shown in FIG. 1, and descriptions thereof are omitted as appropriate. As shown in FIG. 5, a liquid crystal display device 1*a* is provided with a controller 11*a*, instead of the controller 11 of the liquid crystal display device 1 shown in FIG. 1, and is newly provided with a temperature sensor 15. The temperature sensor 15 detects the temperature in the vicinity of the liquid crystal display panel 12. The temperature sensor 15 outputs temperature detection results to the controller 11*a*.

The controller 11*a* is provided with a drive controller 21*a*, instead of the drive controller 21 of the controller 11 shown in FIG. 1. The controller 11*a* switches the time intervals between the output timing of the gate signal to the gate signal lines and the output timing of the source signal corresponding to the gate signal lines, according to the temperature detected by the temperature sensor 15. The drive controller 21*a* determines whether or not the temperature detected by the temperature sensor 15 is equal to or higher than a predetermined temperature. In this embodiment, the temperature sensor 15 corresponds to an example of a temperature detector, and the drive controller 21*a* corresponds to an example of a determination portion.

In FIG. 3 for example, with regard to the time interval D1 between the output timing of the gate signal to the gate signal line G1 and the output timing of the source signal corresponding to the gate signal line G1, the controller 11*a* sets the time interval D1 as D1L in the case where the temperature detected by the temperature sensor 15 is lower than the predetermined temperature, and as D1H in the case where the temperature is equal to or higher than the predetermined temperature. Here, the controller 11*a* sets the time intervals to have the relationship of D1L>D1H.

Similarly, in FIG. 3, the controller 11*a* sets the time intervals D2, D3, D4 and D5 as D2L, D3L, D4L and D5L, respectively, in the case where the temperature detected by the temperature sensor 15 is lower than the predetermined temperature, and as D2H, D3H, D4H and D5H in the case where the temperature is equal to or higher than the predetermined temperature. Although illustrations are omitted in FIG. 3, the controller 11*a* sets the time intervals D6 and D7 as D6L and D7L, respectively, in the case where the temperature detected by the temperature sensor 15 is lower than the predetermined temperature, and as D6H and D7H in the case where the temperature is equal to or higher than the predetermined temperature. The controller 11*a* sets the time intervals to have the relationships of D2L>D2H, D3L>D3H, D4L>D4H, D5L>D5H, D6L>D6H and D7L>D7H.

Generally, response speed of the liquid crystal increases when the temperature becomes higher. For this reason, the influences of the rounding of the waveform are reduced in the liquid crystal display panel 12 when the temperature becomes higher. Therefore, the controller 11*a* sets the time intervals between the output timing of the gate signal to the gate signal lines and the output timing of the source signal corresponding to the gate signal lines to have greater values in the case where the temperature detected by the temperature sensor 15 is lower than the predetermined temperature, as compared with the case where the temperature is equal to or higher than the predetermined temperature, in the embodiment shown in FIG. 5.

Thus, according to the embodiment shown in FIG. 5, the time intervals between the output timing of the gate signal to the gate signal lines and the output timing of the source signal corresponding to the gate signal lines can be set to have appropriate values according to significance of the influences due to the rounding of the waveform.

Figure 6:
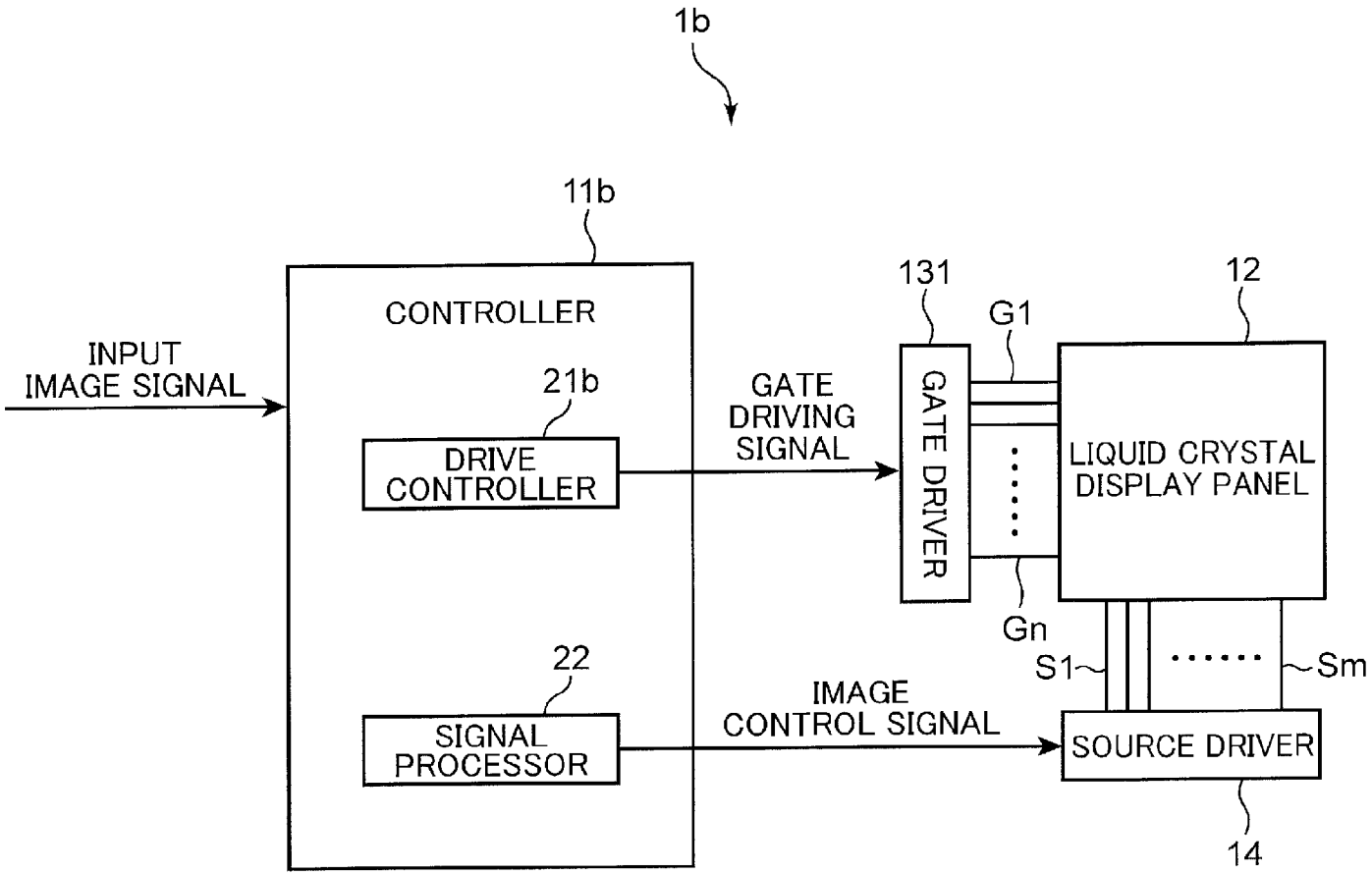
FIG. 6 is a block diagram showing a structure of a liquid crystal display device according to still another embodiment.

FIG. 6 is a block diagram showing a structure of a liquid crystal display device according to still another embodiment. In FIG. 6, the same numerals and symbols are used to designate the same components as those shown in FIG. 1, and descriptions thereof are omitted as appropriate. As shown in FIG. 6, a liquid crystal display device 1*b* is provided with a controller 11*b* instead of the controller 11, and a gate driver 131 instead of the gate driver 13, in the liquid crystal display device 1 shown in FIG. 1. The controller 11*b* is provided with a drive controller 21*b*, instead of the drive controller 21 of the controller 11 shown in FIG. 1.

The drive controller 21*b* outputs a mask signal to the gate driver 131 at predetermined timings. The gate driver 131 has the function of the gate driver 13. Further, the gate driver 131 is configured to stop outputting the gate signal when the mask signal is output from the drive controller 21*b*.

Figure 7:
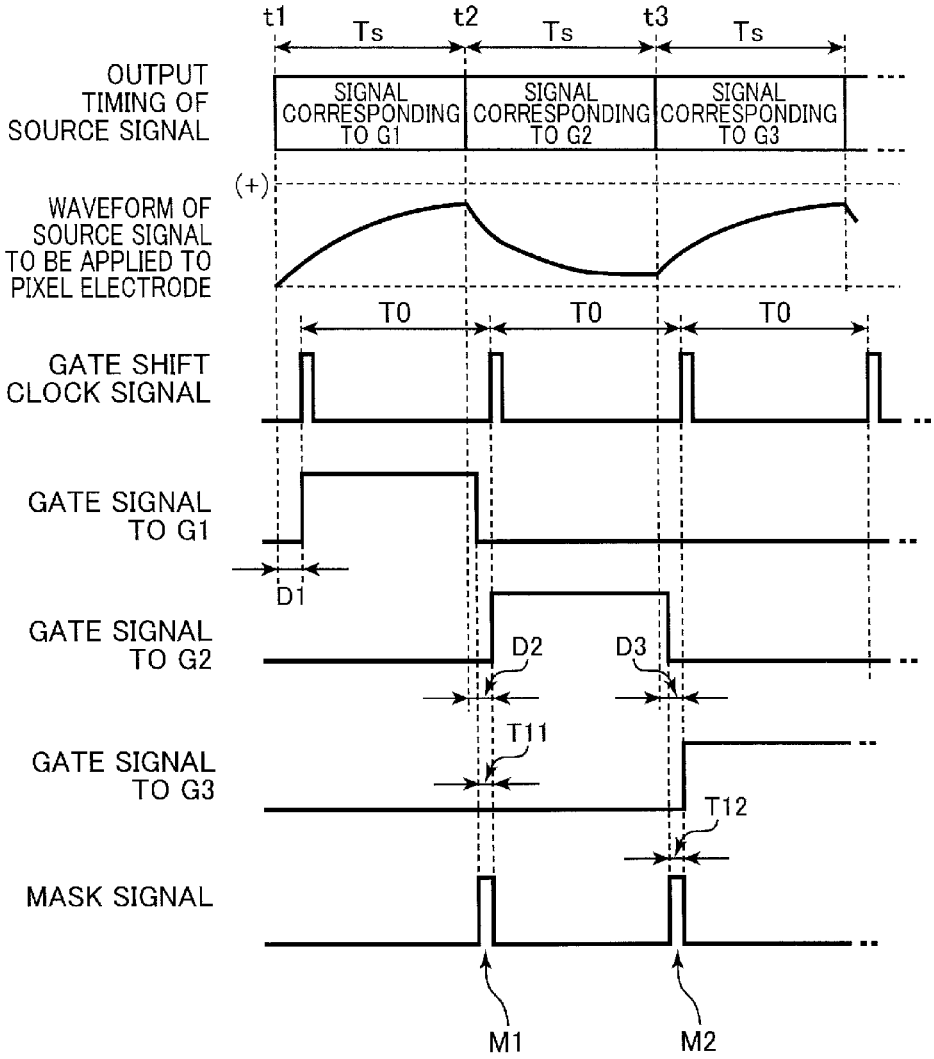
FIG. 7 is a timing chart showing an example of the signals at the respective parts for one frame, according to the embodiment shown in FIG. 6.
Figure 8:
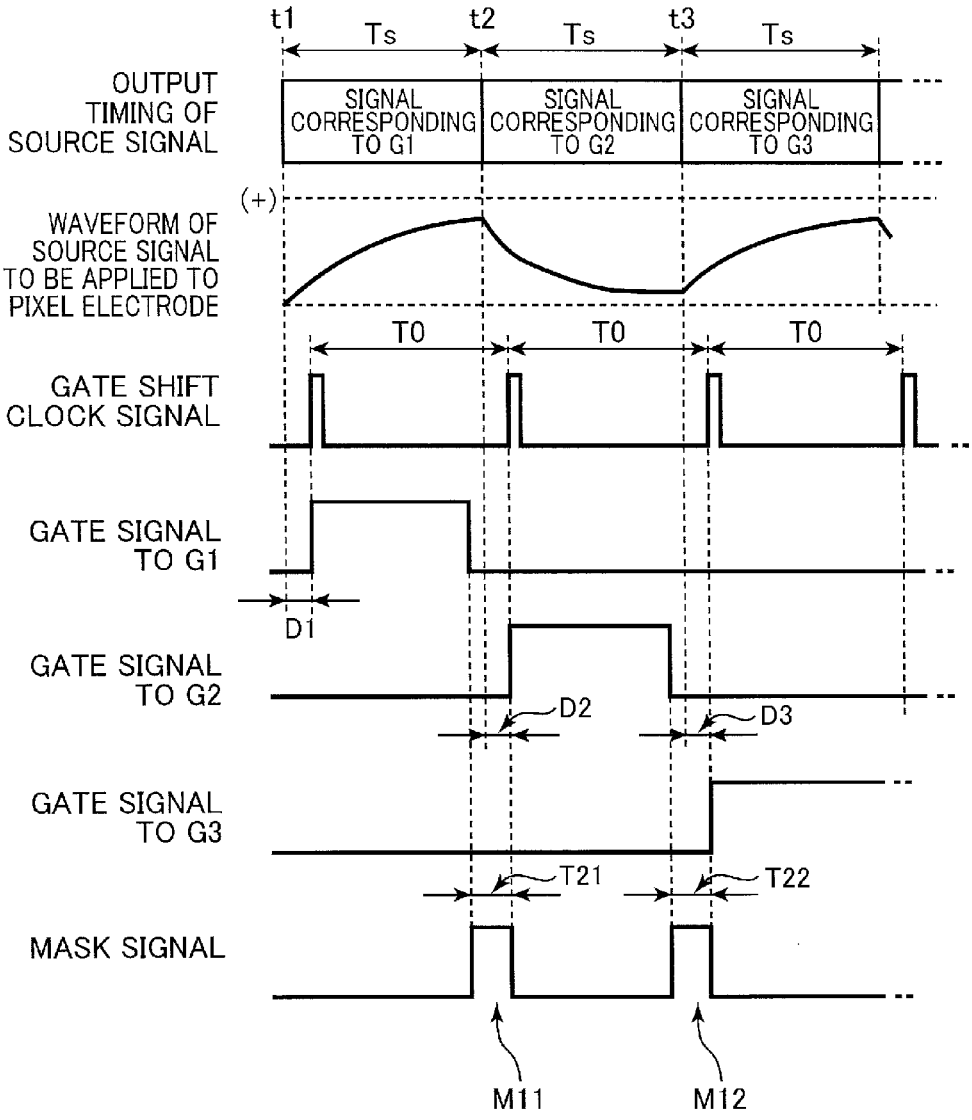
FIG. 8 is a timing chart showing another example of the signals at the respective parts for one frame, according to the embodiment shown in FIG. 6.

FIG. 7 is a timing chart showing an example of the signals at the respective parts for one frame, according to the embodiment shown in FIG. 6. FIG. 8 is a timing chart showing another example of the signals at the respective parts for one frame, according to the embodiment shown in FIG. 6. Only the output timing of the mask signal that is output from the drive controller 21*b* is different between FIG. 7 and FIG. 8. In FIG. 7 and FIG. 8, the same numerals and symbols are used to designate the same components as those shown in FIG. 3. The output timings of the gate signal and the source signal by the controller 11*b*, according to this embodiment, will be described with reference to FIG. 6 to FIG. 8.

As shown in "output timing of source signal" in FIG. 7, the source signal to the source signal lines S1 to Sm is output to each of the gate signal lines G1, G2, G3, . . . in order for the fixed period Ts. Specifically, the source signal to the source signal lines S1 to Sm corresponding to the gate signal line G1 is output for the fixed period Ts from a time t1 to a time t2. Next, the source signal to the source signal lines S1 to Sm corresponding to the gate signal line G2 is output for the fixed period Ts from the time t2 to a time t3. Further, the source signal to the source signal lines S1 to Sm corresponding to the gate signal line G3 is output for the fixed period Ts from the time t3.

According to the operation in FIG. 7, the gate signal to the gate signal line G1 is output at a time after a lapse of the time interval D1 from the time t1, and a mask signal M1 is output from the drive controller 21*b* to the gate driver 131 after the gate signal to the gate signal line G1 is output. Specifically, the mask signal M1 is being output for a period of T11 from a time after the time t2 until a time when the gate signal to the gate signal line G2 is output. Here, a time when the gate signal to the gate signal line G2 is output is a time when the time interval D2 has elapsed since the time t2. Thus, there is the relationship of T11<D2. The output of the gate signal to the gate signal line G1 is stopped while the mask signal M1 is being output.

Similarly, a mask signal M2 is output from the drive controller 21*b* to the gate driver 131 after the gate signal to the gate signal line G2 is output. Specifically, the mask signal M2 is being output for a period of T12 from a time after the time t3 until a time when the gate signal to the gate signal line G3 is output. Here, the gate signal to the gate signal line G3 is output after a lapse of the time interval D3 from the time t3. Thus, there is the relationship of T12<D3. The output of the gate signal to the gate signal line G2 is stopped while the mask signal M2 is being output.

As shown in FIG. 7, the gate signal to the gate signal line G1 is still being output when the output of the source signal corresponding to the gate signal line G2 is started at the time t2. Accordingly, the source signal corresponding to the gate signal line G2 is applied to the pixel electrodes connected to the gate signal line G1. However, the mask signal M1 is output to stop the output of the gate signal to the gate signal line G1. As a result of this, the source signal corresponding to the gate signal line G2 is not applied to the pixel electrodes connected to the gate signal line G1.

Similarly, the gate signal to the gate signal line G2 is still being output when the output of the source signal corresponding to the gate signal line G3 is started at the time t3. Accordingly, the source signal corresponding to the gate signal line G3 is applied to the pixel electrodes connected to the gate signal line G2. However, the mask signal M2 is output to stop the output of the gate signal to the gate signal line G2. As a result of this, the source signal corresponding to the gate signal line G3 is not applied to the pixel electrodes connected to the gate signal line G2.

In this way, in the operation in FIG. 7, the drive controller 21*b* outputs the mask signal M1 to the gate driver 131 from a time after the output of the gate signal to the gate signal line G1 is started until a time when the output of the gate signal to the gate signal line G2 is started. Further, the drive controller 21*b* outputs the mask signal M2 to the gate driver 131 from a time after the output of the gate signal to the gate signal line G2 is started until a time when the output of the gate signal to the gate signal line G3 is started. This makes it possible to reduce a degree of influences due to the application of the source signal to the pixel electrodes connected to the gate signal line that is next to the desired gate signal line. In the operation in FIG. 7, the gate signal to the gate signal line G1 corresponds to an example of a first gate signal, the gate signal to the gate signal line G2 corresponds to an example of a second gate signal, the gate signal to the gate signal line G3 corresponds to an example of a third gate signal, the mask signal M1 corresponds to an example of a first mask signal, and the mask signal M2 corresponds to an example of a second mask signal.

Meanwhile, in the operation in FIG. 8, the gate signal to the gate signal line G1 is output at a time after a lapse of the time interval D1 from the time t1, and a mask signal M11 is output from the drive controller 21*b* to the gate driver 131 after the gate signal to the gate signal line G1 is output. Specifically, the mask signal M11 is being output for a period of T21 from a time before the time t2 until a time when the gate signal to the gate signal line G2 is output. Here, the gate signal to the gate signal line G2 is output at a time after a lapse of the time interval D2 from the time t2. Thus, there is the relationship of T21>D2. The output of the gate signal to the gate signal line G1 is stopped while the mask signal M11 is being output.

Similarly, a mask signal M12 is output from the drive controller 21*b* to the gate driver 131 after the gate signal to the gate signal line G2 is output. Specifically, the mask signal M12 is being output for a period of T22 from a time before the time t2 until a time when the gate signal to the gate signal line G3 is output. Here, the gate signal to the gate signal line G3 is output at a time after a lapse of the time interval D3 from the time t3. Thus, there is the relationship of T22>D3. The output of the gate signal to the gate signal line G2 is stopped while the mask signal M12 is being output.

In FIG. 8, the output of the gate signal to the gate signal line G1 is stopped by the mask signal M11 before the output of the source signal corresponding to the gate signal line G2 is started at the time t2, unlike in the case of FIG. 7. Consequently, the source signal corresponding to the gate signal line G2 is not applied to the pixel electrodes connected to the gate signal line G1. Similarly, the output of the gate signal to the gate signal line G2 is stopped by the mask signal M12 before the output of the source signal corresponding to the gate signal line G3 is started at the time t3. Consequently, the source signal corresponding to the gate signal line G3 is not applied to the pixel electrodes connected to the gate signal line G2.

In this way, in the operation in FIG. 8, the drive controller 21*b* outputs the mask signal M11 to the gate driver 131 from a time, which is after the output of the gate signal to the gate signal line G1 is started and before the output of the source signal corresponding to the gate signal line G2 is started, until a time when the output of the gate signal to the gate signal line G2 is started. Further, the drive controller 21*b* outputs the mask signal M12 to the gate driver 131 from a time, which is after the output of the gate signal to the gate signal line G2 is started and before the output of the source signal corresponding to the gate signal line G3 is started, until a time when the output of the gate signal to the gate signal line G3 is started. This makes it possible to prevent application of the source signal to the pixel electrodes connected to the gate signal line that is next to the desired gate signal line. In the operation in FIG. 8, the gate signal to the gate signal line G1 corresponds to an example of a first gate signal, the gate signal to the gate signal line G2 corresponds to an example of a second gate signal, the source signal corresponding to the gate signal line G2 corresponds to an example of a second source signal, the source signal corresponding to the gate signal line G3 corresponds to an example of a third source signal, the mask signal M11 corresponds to an example of a first mask signal, and the mask signal M12 corresponds to an example of a second mask signal.

It should be noted that, in the above embodiments, the signal processor 22 may shift the level of the voltage (source signal) to be applied to the pixel electrodes so that the voltage changes more significantly, as compared with the level based on the input image signal. In FIG. 3 for example, the level of the source signal corresponding to the gate signal line G1 may be increased in a direction of (+). Further, the level of the source signal corresponding to the gate signal line G2 may be reduced in a direction closer to zero. When the level of the source signal output from the signal processor 22 is shifted in an overdrive direction like this, it is possible to increase the speed of the response of the liquid crystal. When the signal processor 22 controls to shift the level of the source signal in the overdrive direction like this, the influences due to the rounding of the waveform of the source signal, as described in the embodiments, are increased, and therefore, high effectiveness can be achieved with the above embodiments.

Note that the specific embodiments as described above mainly include the embodiments having the following structures.

In one general aspect, the instant application describes a display device which may include a display portion that has a source signal line extending from a first end to a second end, a first gate signal line crossing the source signal line, a second gate signal line crossing the source signal line at a position closer to the second end than the first gate signal line, a first pixel electrode connected to the source signal line and the first gate signal line, and a second pixel electrode connected to the source signal line and the second gate signal line; a source driver that is connected to the second end of the source signal line to output to the source signal line a first source signal for the first pixel electrode and a second source signal for the second pixel electrode; a gate driver that outputs a first gate signal to the first gate signal line and a second gate signal to the second gate signal line; and a controller that controls the gate driver and the source driver to control output timings of the first gate signal and the second gate signal relative to output timings of the first source signal and the second source signal, wherein the controller sets a first time interval from the output timing of the first source signal to the output timing of the first gate signal to be longer than a second time interval from the output timing of the second source signal to the output timing of the second gate signal.

According to this structure, the source signal line extends from the first end to the second end. The first gate signal line crosses the source signal line. The second gate signal line crosses the source signal line at the position closer to the second end than the first gate signal line. The first pixel electrode is connected to the source signal line and the first gate signal line. The second pixel electrode is connected to the source signal line and the second gate signal line. The source driver is connected to the second end of the source signal line. The first source signal and the second source signal are output to the source signal line by the source driver. The gate driver outputs the first gate signal to the first gate signal line and outputs the second gate signal to the second gate signal line. The controller controls the gate driver and the source driver to control the output timings of the first gate signal and the second gate signal relative to the output timings of the source signals. The controller sets the first time interval from the output timing of the first source signal to the output timing of the first gate signal to be longer than the second time interval from the output timing of the second source signal to the output timing of the second gate signal.

In this way, the source driver is connected to the second end of the source signal line. Thus, the distance between the source driver and the first pixel electrode is longer than the distance between the source driver and the second pixel electrode. Therefore, when the source signal is output from the source driver, the waveform of the source signal in the first pixel electrode is rounded, as compared with the waveform of the source signal in the second pixel electrode.

According to this structure, however, the first time interval is longer than the second time interval. In other words, the first time interval from the output timing of the first source signal to the output timing of the first gate signal is longer than the second time interval from the output timing of the second source signal to the output timing of the second gate signal. Thus, the first gate signal is output after the waveform of the source signal is changed sufficiently, even though the waveform of the source signal in the first pixel electrode is rounded as compared with the waveform of the source signal in the second pixel electrode. Therefore, it is possible to reduce the influences due to the difference between the waveforms of the source signals in the first pixel electrode and in the second pixel electrode, having different distances from the source driver, with a simple control structure that only increases the first time interval to be longer than the second time interval. As a result of this, it is possible to reduce the degree of deterioration in the quality of the image to be displayed on the display portion.

The above general aspect may include one or more of the following features. The first time interval may be determined in accordance with a distance from the source driver to the first pixel electrode, and the second time interval may be determined in accordance with a distance from the source driver to the second pixel electrode.

According to this structure, the first time interval is determined in accordance with the distance from the source driver to the first pixel electrode, and the second time interval is determined in accordance with the distance from the source driver to the second pixel electrode. Therefore, the first time interval and the second time interval can be set to have appropriate intervals corresponding to the degree of rounding of the waveform of the source signal.

The first gate signal line and the second gate signal line may be arranged next to each other, the gate driver may output the second gate signal to the second gate signal line immediately after outputting the first gate signal to the first gate signal line, the controller may have a first control mode in which polarity of the second source signal is inverted relative to polarity of the first source signal and a second control mode in which the polarity of the second source signal is not inverted relative to the polarity of the first source signal, as control modes for controlling the source driver, and the second time interval in the first control mode may be set to be longer than the second time interval in the second control mode.

According to this structure, the first gate signal line and the second gate signal line are arranged next to each other. The gate driver outputs the second gate signal to the second gate signal line immediately after outputting the first gate signal to the first gate signal line. The controller has a first control mode in which polarity of the second source signal is inverted relative to polarity of the first source signal, and a second control mode in which the polarity of the second source signal is not inverted relative to the polarity of the first source signal, as control modes for controlling the source driver. The second time interval in the first control mode is longer than the second time interval in the second control mode.

The degree of rounding of the waveform of the source signal is increased in a case where the polarity of the second source signal is inverted relative to the polarity of the first source signal that is output immediately before the second source signal, as compared with a case where the polarity is not inverted. According to this structure, however, the second time interval in the first control mode, in which the polarity of the second source signal is inverted relative to the polarity of the first source signal, is longer than the second time interval in the second control mode, in which the polarity is not inverted. Therefore, the second time interval can be set to have the appropriate interval corresponding to the degree of rounding of the waveform of the source signal.

The display device may include a temperature detector that detects a temperature corresponding to a temperature of the display portion, wherein the display portion may include a liquid crystal display portion that displays an image using liquid crystal, and the controller may include a determination portion that determines whether or not the temperature detected by the temperature detector is equal to or higher than a predetermined temperature; and may control the gate driver so that the first time interval and the second time interval become longer, in a case where a determination result by the determination portion represents that the temperature detected by the temperature detector is lower than the predetermined temperature, as compared with a case where the determination result by the determination portion represents that the temperature detected by the temperature detector is equal to or higher than the predetermined temperature.

According to this structure, a temperature corresponding to a temperature of the display portion is detected by a temperature detector. The display portion is a liquid crystal display portion that displays an image using liquid crystal. The determination portion determines whether or not the temperature detected by the temperature detector is equal to or higher than a predetermined temperature. The controller controls the gate driver so that the first time interval and the second time interval become longer, in a case where a determination result by the determination portion represents that the temperature detected by the temperature detector is lower than the predetermined temperature, as compared with a case where the determination result by the determination portion represents that the temperature detected by the temperature detector is equal to or higher than the predetermined temperature.

Here, the response speed of the liquid crystal is reduced in a case where the temperature is lower than the predetermined temperature, as compared with a case where the temperature is equal to or higher than the predetermined temperature. For this reason, the influences of the rounding of the waveform of the source signal increase in a case where the temperature is lower than the predetermined temperature, as compared with a case where the temperature is equal to or higher than the predetermined temperature. Meanwhile, according to this structure, the first time interval and the second time interval become longer in a case where the temperature is lower than the predetermined temperature, as compared with a case where the temperature is equal to or higher than the predetermined temperature. Therefore, the first time interval and the second time interval can be set to have the appropriate intervals corresponding to the response speed of the liquid crystal.

The display portion may include a third gate signal line crossing the source signal line at a position closer to the second end than the second gate signal line, and a third pixel electrode connected to the source signal line and the third gate signal line, the second gate signal line may be arranged next to the first gate signal line and the third gate signal line, the source driver may output to the source signal line a third source signal for the third pixel electrode, the gate driver may output a third gate signal to the third gate signal line, and the controller may set the second time interval to be longer than a third time interval from an output timing of the third source signal to an output timing of the third gate signal; and may set a time interval between the output timing of the third source signal and the output timing of the second source signal to be substantially equal to a time interval between the output timing of the second source signal and the output timing of the first source signal.

According to this structure, the third gate signal line crosses the source signal line at the position closer to the second end than the second gate signal line. The third pixel electrode is connected to the source signal line and the third gate signal line. The second gate signal line is arranged next to the first gate signal line and the third gate signal line. The source driver outputs the third source signal to the source signal line. The gate driver outputs the third gate signal to the third gate signal line.

The controller sets the second time interval to be longer than the third time interval from the output timing of the third source signal to the output timing of the third gate signal. Thus, the second gate signal is output after the waveform of the source signal is changed sufficiently, even though the waveform of the source signal in the second pixel electrode is rounded as compared with the waveform of the source signal in the third pixel electrode. Therefore, it is possible to reduce the influences due to the difference between the waveforms of the source signals in the second pixel electrode and in the third pixel electrode, having different distances from the source driver, with the simple control structure that increases the second time interval to be longer than the third time interval.

Further, the controller sets the time interval between the output timing of the third source signal and the output timing of the second source signal to be substantially equal to the time interval between the output timing of the second source signal and the output timing of the first source signal. Thus, it is possible to set the application period of the first source signal and the application period of the second source signal to be substantially equal to each other. As a result of this, the application of the first source signal and the second source signal can be made preferably with the simple structure.

The display portion may include a third gate signal line crossing the source signal line at a position closer to the second end than the second gate signal line, and a third pixel electrode connected to the source signal line and the third gate signal line, the second gate signal line is arranged next to the first gate signal line and the third gate signal line, the source driver may output to the source signal line a third source signal for the third pixel electrode, the gate driver may output a third gate signal to the third gate signal line, and the controller: may set the second time interval to be longer than a third time interval from an output timing of the third source signal to an output timing of the third gate signal; and may set a time interval between the output timing of the first gate signal and the output timing of the second gate signal to be substantially equal to a time interval between the output timing of the second gate signal and the output timing of the third gate signal.

According to this structure, the third gate signal line crosses the source signal line at the position closer to the second end than the second gate signal line. The third pixel electrode is connected to the source signal line and the third gate signal line. The second gate signal line is arranged next to the first gate signal line and the third gate signal line. The source driver outputs the third source signal to the source signal line. The gate driver outputs the third gate signal to the third gate signal line.

The controller sets the second time interval to be longer than the third time interval from the output timing of the third source signal to the output timing of the third gate signal. Thus, the second gate signal is output after the waveform of the source signal is changed sufficiently, even though the waveform of the source signal in the second pixel electrode is rounded as compared with the waveform of the source signal in the third pixel electrode. Therefore, it is possible to reduce the influences due to the difference between the waveforms of the source signals in the second pixel electrode and in the third pixel electrode, having different distances from the source driver, with the simple control structure that only increases the second time interval to be longer than the third time interval.

Further, the controller sets the time interval between the output timing of the first gate signal and the output timing of the second gate signal to be substantially equal to the time interval between the output timing of the second gate signal and the output timing of the third gate signal. Therefore, the output period of the first gate signal and the output period of the second gate signal are substantially equal to each other. Thus, it is possible to set the application period of the first source signal and the application period of the second source signal to be substantially equal to each other. As a result of this, the application of the first source signal and the second source signal can be made preferably with the simple structure.

The controller may output a first mask signal and a second mask signal to the gate driver, the gate driver may be configured to stop the output of the first gate signal and the second gate signal, when the first mask signal is output from the controller, and may be configured to stop the output of the second gate signal and the third gate signal, when the second mask signal is output from the controller, and the controller may output the first mask signal to the gate driver after the first gate signal is output and before the second gate signal is output, and may output the second mask signal to the gate driver after the second gate signal is output and before the third gate signal is output.

According to this structure, the controller outputs a first mask signal and a second mask signal to the gate driver. The gate driver is configured to stop the output of the first gate signal and the second gate signal, when the first mask signal is output from the controller, and is configured to stop the output of the second gate signal and the third gate signal, when the second mask signal is output from the controller. The controller outputs the first mask signal to the gate driver after the first gate signal is output and before the second gate signal is output. Thus, the output of the first gate signal is stopped. This makes it possible to reduce the degree of the influences due to the application of the second source signal to the first pixel electrode. Further, the controller outputs the second mask signal to the gate driver after the second gate signal is output and before the third gate signal is output. Thus, the output of the second gate signal is stopped. This makes it possible to reduce the degree of the influences due to the application of the third source signal to the second pixel electrode.

The controller may output the first mask signal to the gate driver after the first gate signal is output and before the second source signal is output, and may output the second mask signal to the gate driver after the second gate signal is output and before the third source signal is output.

According to this structure, the controller outputs the first mask signal to the gate driver after the first gate signal is output and before the second source signal is output. Therefore, the output of the first gate signal is stopped before the second source signal is output. This makes it possible to prevent the application of the second source signal to the first pixel electrode. Further, the controller outputs the second mask signal to the gate driver after the second gate signal is output and before the third source signal is output. Therefore, the output of the second gate signal is stopped before the third source signal is output. This makes it possible to prevent the application of the third source signal to the second pixel electrode.

Industrial Applicability

The present disclosure is useful as a display device that is capable of reducing influences due to a difference between waveforms of source signals, caused by positions of pixel electrodes, in a display device that displays images on a display portion.

What is claimed is:

1. A display device comprising:

a display portion that has a source signal line extending from a first end to a second end, a first gate signal line crossing the source signal line, a second gate signal line crossing the source signal line at a position closer to the second end than the first gate signal line, a first pixel electrode connected to the source signal line and the first gate signal line, and a second pixel electrode connected to the source signal line and the second gate signal line;

a source driver that is connected to the second end of the source signal line to output to the source signal line a first source signal for the first pixel electrode and a second source signal for the second pixel electrode;

a gate driver that outputs a first gate signal to the first gate signal line and a second gate signal to the second gate signal line; and a controller that controls the gate driver and the source driver to control output timings of the first gate signal and the second gate signal relative to output timings of the first source signal and the second source signal, wherein the controller sets the first gate signal to be later than the first source signal by a first amount based on the ddistance of the first pixel electrode from the source driver, and sets the second gate signal to be later than the second source signal by a second amount based on the distance of the second pixel electrode from the source driver, so as to set a first time interval from the output timing of the first source signal to the output timing of the first gate signal to be longer than a second time interval from the output timing of the second source signal to the output timing of the second gate signal.

2. The display device according to claim 1, wherein the first time interval is determined in accordance with the distance from the source driver to the first pixel electrode, and the second time interval is determined in accordance with the distance from the source driver to the second pixel electrode.

3. The display device according to claim 1, wherein the first gate signal line and the second gate signal line are arranged next to each other, the gate driver outputs the second gate signal to the second gate signal line immediately after outputting the first gate signal to the first gate signal line, the controller has a first control mode in which polarity of the second source signal is inverted relative to polarity of the first source signal and a second control mode in which the polarity of the second source signal is not inverted relative to the polarity of the first source signal, as control modes for controlling the source driver, and the second time interval in the first control mode is set to be longer than the second time interval in the second control mode.

4. The display device according to claim 1, further comprising a temperature detector that detects a temperature corresponding to a temperature of the display portion, wherein the display portion includes a liquid crystal display portion that displays an image using liquid crystal, and the controller:

includes a determination portion that determines whether or not the temperature detected by the temperature detector is equal to or higher than a predetermined temperature; and controls the gate driver so that the first time interval and the second time interval become longer, in a case where a determination result by the determination portion represents that the temperature detected by the temperature detector is lower than the predetermined temperature, as compared with a case where the determination result by the determination portion represents that the temperature detected by the temperature detector is equal to or higher than the predetermined temperature.

5. The display device according to claim 1, wherein the display portion further includes a third gate signal line crossing the source signal line at a position closer to the second end than the second gate signal line, and a third pixel electrode connected to the source signal line and the third gate signal line, the second gate signal line is arranged next to the first gate signal line and the third gate signal line, the source driver outputs to the source signal line a third source signal for the third pixel electrode, the gate driver outputs a third gate signal to the third gate signal line, and the controller:

sets the second time interval to be longer than a third time interval from an output timing of the third source signal to an output timing of the third gate signal; and sets a time interval between the output timing of the third source signal and the output timing of the second source signal to be substantially equal to a time interval between the output timing of the second source signal and the output timing of the first source signal.

6. The display device according to claim 1, wherein the display portion further includes a third gate signal line crossing the source signal line at a position closer to the second end than the second gate signal line, and a third pixel electrode connected to the source signal line and the third gate signal line, the second gate signal line is arranged next to the first gate signal line and the third gate signal line, the source driver outputs to the source signal line a third source signal for the third pixel electrode, the gate driver outputs a third gate signal to the third gate signal line, and the controller:

sets the second time interval to be longer than a third time interval from an output timing of the third source signal to an output timing of the third gate signal; and sets a time interval between the output timing of the first gate signal and the output timing of the second gate signal to be substantially equal to a time interval between the output timing of the second gate signal and the output timing of the third gate signal.

7. The display device according to claim 5, wherein the controller outputs a first mask signal and a second mask signal to the gate driver, the gate driver is configured to stop the output of the first gate signal and the second gate signal, when the first mask signal is output from the controller, and is configured to stop the output of the second gate signal and the third gate signal, when the second mask signal is output from the controller, and the controller outputs the first mask signal to the gate driver after the first gate signal is output and before the second gate signal is output, and outputs the second mask signal to the gate driver after the second gate signal is output and before the third gate signal is output.

8. The display device according to claim 7, wherein the controller outputs the first mask signal to the gate driver after the first gate signal is output and before the second source signal is output, and outputs the second mask signal to the gate driver after the second gate signal is output and before the third source signal is output.

* * * * *